US005330380A

United States Patent [19]

McDarren et al.

[11] Patent Number: 5,330,380

[45] Date of Patent: Jul. 19, 1994

[54] AUDIBLE MESSAGE/INFORMATION DELIVERY SYSTEM

[75] Inventors: Robert McDarren, Ridgefield, Conn.; Joseph Truchsess, City Island, N.Y.

[73] Assignee: Link Group International, Ridgefield, Conn.

[21] Appl. No.: 31,312

[22] Filed: Mar. 15, 1993

[51] Int. Cl.[5] ..... A63H 33/00

[52] U.S. Cl. ..... 446/397; 434/308

[58] Field of Search ..... 446/397, 297, 303, 409; 434/308, 223, 159, 169, 335

[56] References Cited

U.S. PATENT DOCUMENTS

| | | | |
|---|---|---|---|
| 4,333,258 | 6/1982 | McCaslin | 446/397 X |
| 4,729,564 | 3/1988 | Kuna et al. | 446/303 X |
| 4,820,233 | 4/1989 | Weiner | 434/308 X |
| 4,968,255 | 11/1990 | Lee et al. | 434/159 |
| 4,980,919 | 12/1990 | Tsai | 434/335 X |
| 5,127,869 | 7/1992 | Hanzawa | 446/397 |

*Primary Examiner*—Mickey Yu
*Attorney, Agent, or Firm*—Melvin I. Stoltz

[57] ABSTRACT

A unique audible message or information delivery system particularly suited for toys is realized by providing each model or type of toy in a particular group or class with a unique identification code and also providing a message delivery and handling assembly which incorporates a plurality of independent messages, each of which are specifically related to one particular toy model and are constructed for being delivered by the message delivery assembly upon receipt of the particular identification code. In this way, whenever a toy model interfaces with the information/message delivery assembly, the unique, identifying code associated with the model is received by the information/message delivery assembly and is processed for activating the audible presentation of the specifically designated message associated with that particular model. By employing this invention, every different model or type of toy in a group or class of toys is able to interface with the same information/message delivery assembly and cause a different, unique, specifically designated message to be audibly delivered. By providing an audio producing information delivery assembly uniquely constructed for a particular group or class of toys, any toy group or class is capable of being constructed with identification codes associated therewith for having specially designated messages audibly delivered in response to receipt of a particular code.

18 Claims, 4 Drawing Sheets

AUDIBLE MESSAGE/INFORMATION DELIVERY SYSTEM

BACKGROUND ART

During the last several years, various child-oriented products have been developed which incorporate electronic circuitry for providing audible sounds or messages. Typically, these prior art sound producing toys are in the form of puzzles, display boards, or panels which enable certain sounds to be made when either a puzzle piece or a movable member is positioned to activate the system to produce the particular sound or message.

In addition, numerous toy dolls have been manufactured and sold over the last several years which incorporate circuitry for enabling the doll to enunciate messages, whenever activated. Such dolls have also been constructed with removable or replaceable sound producing chips in order to increase the vocabulary which the doll is capable of providing.

Furthermore, additional sound producing toys have been manufactured wherein action figures or attachments for the action figures are capable of producing sound effects associated with various activities for which the action figure is constructed. In this regard, an action figure incorporating a machine gun would be capable of producing machine gun like sounds when activated by the user.

Although much effort has been expended in developing a wide variety of sound producing toys in order to capture the imagination and interest of children, no construction has been developed which enables one group or class of toys which has a variety of models or different types within the class, to be separately placed on a message delivery system and have the system produce a unique message for that model. In particular, no prior art construction provides a system which produces a unique, specially created message relating specifically to the model or type of toy within the group being placed on the message delivery system at that time.

Typically, prior art systems have only been able to provide repeatable messages which are unrelated to the particular toy or model a child is using. Furthermore, prior art sound or message configurations have been unable to accommodate the addition of new models or types in a particular toy group. As a result, these prior art systems have been limited in their appeal or interest by children, due to the inherent limitation in their construction.

Therefore, it is a principal object of the present invention to provide a single, message delivery system which is capable of interfacing with a plurality of different models or particular types of group or class of toys and producing specific, separate, individualized messages for each particular model or type interfaced therewith.

Another object of the present invention is to provide a message delivery system having the characteristic features described above which is capable of accommodating expansion and improvements in the different types or models of one class of toys.

Another object of the present invention is to provide a message delivery system which can be universally employed by children for obtaining specific information about each and every different model of one type of toy in the child's possession.

A further object of the present invention is to provide a message delivery system which expands the knowledge of children regarding the toys with which they play while also imparting the educational benefit in a constructive, fun environment.

Other and more specific object will in part be obvious and will in part appear hereinafter.

SUMMARY OF THE INVENTION

The present invention overcomes the prior art difficulties and drawbacks by providing an audio producing information or message delivery system which incorporates a plurality of independent, specific messages and is constructed for being activated by interfacing with a message selecting code associated with each model or type of toy in a particular group for which the system has been created. When one toy model interfaces with the audio producing information/message delivery system of this invention, a unique, identifying code is received by the information/message delivery system which is processed for activating the audible presentation of a particular, specifically designated message relating to that particular toy model. In this way, every different model or type of toy in a group or class of toys is able to interface with the same information/message delivery center and cause a different, "tailor-made", specifically designated message to be audibly delivered.

In view of the unique aspects of the present invention and its broad applicability, a wide variety of toys can be constructed employing the unique features of this invention. As an example, toy groups or classes such as cars, dolls, stuffed animals, trucks, airplanes, action figures, etc., can effectively employ the present invention, since each of the groups contain a plurality of types or models. In order to implement the present invention, each type or model in the group has a specially designated, unique message created for that model which would relate to the attributes, characteristics, or qualities of that particular model. Then, by incorporating a specific code on the model and transmitting that code to the information/message delivery system, that special message is audibly delivered in response to activation of the information/message delivery system.

As an example, cars or vehicles represent one group of toys which have numerous different models, with each model representing a different automobile manufacturer or body type. By employing this invention, each model car or vehicle incorporates a unique code associated therewith, which is transmitted, when desired, to the information/message delivery system of the present invention. Once the unique code is received, the system delivers the precise message specifically created for that particular model vehicle. In this way, information such as the history of the actual vehicle, its horsepower, speed, physical attributes, etc. are audibly presented, thereby providing useful facts and information to the child or user of the system.

Similarly, other toys such as airplanes, trucks, action figures, and the like can have independent messages created for each model of toy informing the user of relevant facts or information associated with that particular model. In addition, other toys, such as dolls, figures, stuffed animals, and the like can be constructed with an identifying code which enables the audible message/information delivery system of the present invention to deliver a unique, specially designed message, relating to the characteristics of the doll, figure, or stuffed animal, as well as its unique attributes or personality. In this way, greater personalized information about each type or model of toy in a group or class of toys can be enjoyed by children to a substantially greater extent, since children will now obtain factual information or relevant insights into the habits, likes, or dislikes of the doll or stuffed animal with which the child is playing.

In the present invention, the message/information delivery system is constructed for easily, separately interfacing with each of the different models or types of toys in that particular group or class, with each model or type having a unique identifying code associated therewith. During this interfacing engagement, the system reads the unique identifying code of the particular model, and processes the code information to deliver the precise message associated with that model. In this way, when activated, the system provides a particular, specially designated message relating to the particular model or type of toy the child has selected.

Although the actual reading of the code from the model can be achieved in a variety of code reading systems, including electronic scanning of bar codes, it is preferred that mechanical switch means are employed for reliability and reduced expense. However, electronic scanning systems can be employed without departing from the scope of this invention.

In addition, in the preferred construction of the present invention, a separate activation switch is employed for activating information/message delivery system to audibly enunciate the particular message corresponding to the model or type of toy which has been interfaced with the system. Although immediate delivery of a message upon placement of a particular model or type of toy on this system can be provided, it is preferred that a separate activation trigger switch be used in order to assure that the entire identifying code has been transmitted to the system before the message is delivered.

In this way, unwanted delivery of erroneous, nonconforming messages is avoided and greater assurance is provided that only the specific message for the precisely desired model is delivered. By employing this trigger switch construction, greater reliability and efficacy of the present invention is attained and confidence in the system's ability to accurately deliver only the desired message is established.

The invention accordingly comprises the features of construction, combinations of elements, and arrangement of parts which will be exemplified in the constructions hereinafter set forth and the scope of the invention will be indicated in the claims.

THE DRAWINGS

For a fuller understanding of the nature and objects of the present invention, reference should be had to the following detailed description taken in connection with the accompanying drawings, in which.

DETAILED DESCRIPTION

By referring to FIGS. 1 through 9, along with the following detailed disclosure, the construction and operation of the audible message/information delivery system of this invention can best be understood. In FIGS. 1–9, the present invention is depicted in association with toy vehicles, which have been selected as one group or class of toys, for exemplary purposes only.

As discussed above, the present invention is applicable to any group or class of toys having a plurality of models or types within the class. Since this scope encompasses a wide variety of different toys, such as dolls, stuffed animals, trucks, airplanes, action figures, etc., the use of toy cars in the figures and in the following detailed disclosure has merely been selected as one representative example of a toy group or class within which the present invention can be efficaciously employed. However, it should be clearly understood that no limitation of the present invention is intended by the selection of this representative example.

Figure 1:
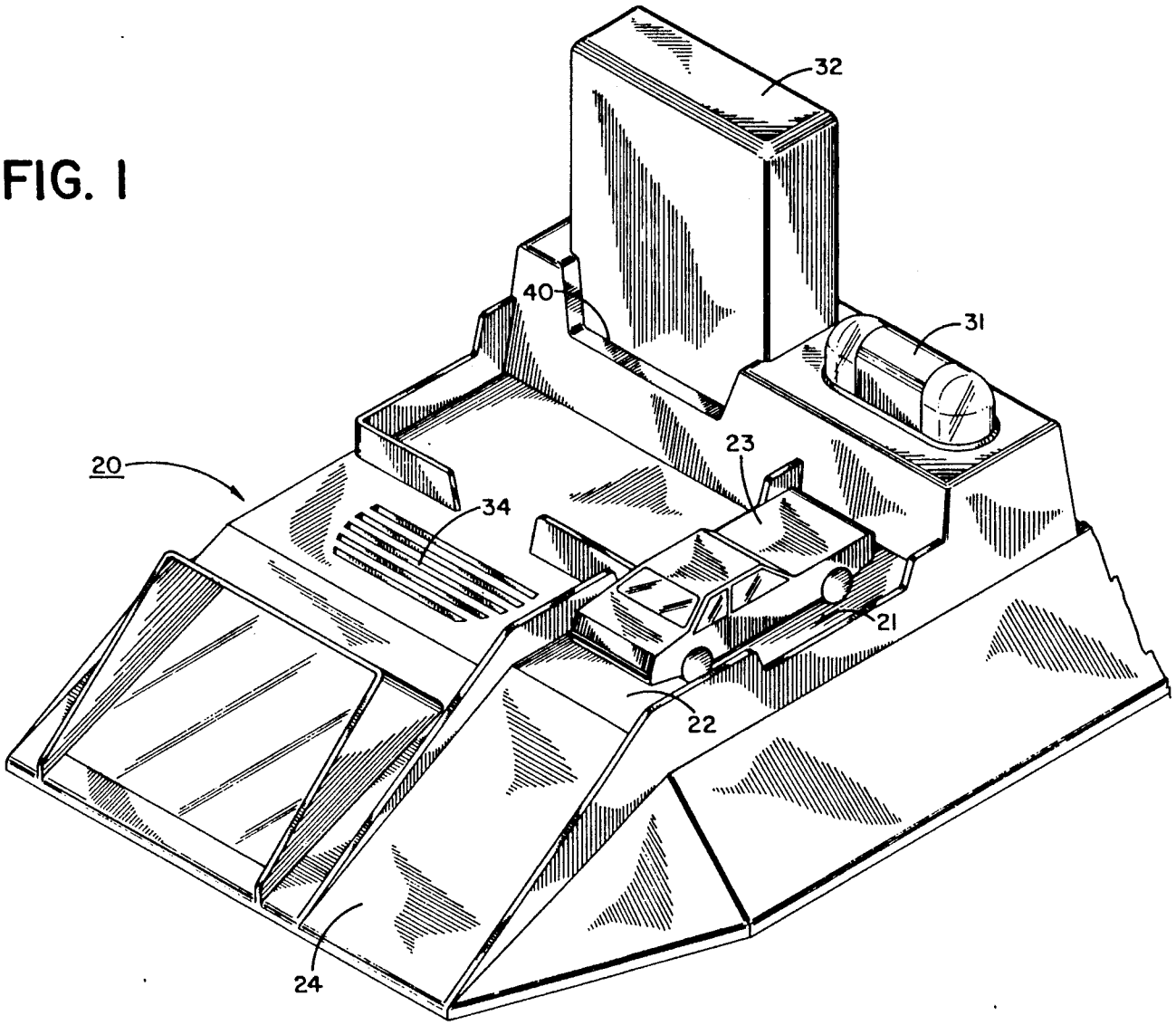
FIG. 1 is a perspective view of an activity center constructed for model vehicles which incorporate the audible message/information delivery system of the present invention.
Figure 2:
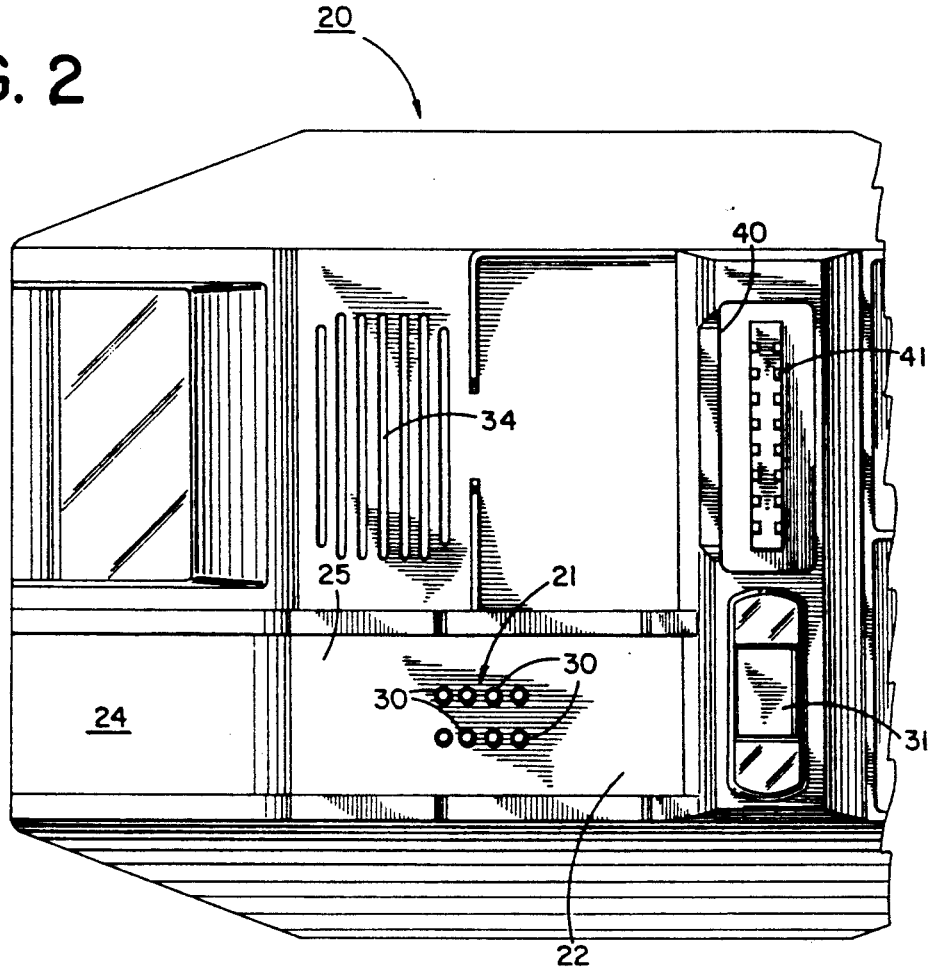
FIG. 2 is a top plan view, partially broken away, of the activity center of FIG. 1.
Figure 3:
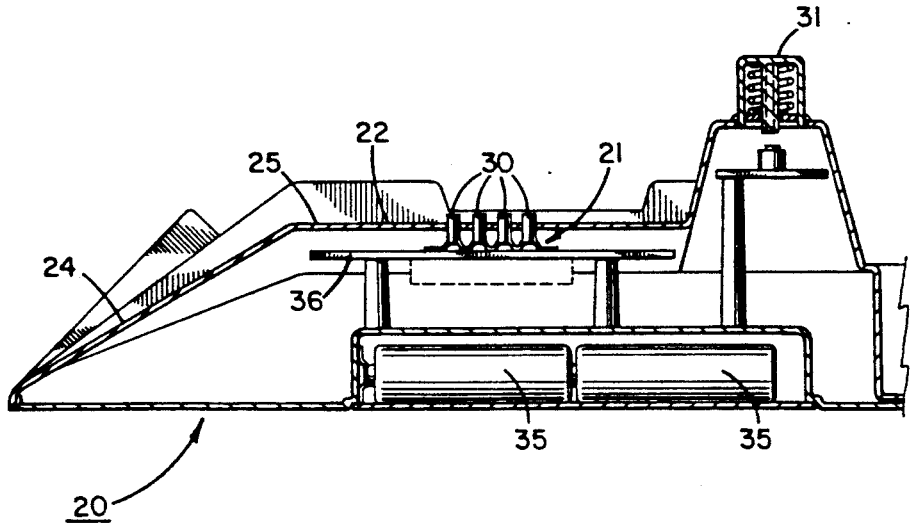
FIG. 3 is a cross-sectional side elevation view, partially broken away, taken along line 3—3 of FIG. 2.

In FIGS. 1–3, the audible message/information delivery system of the present invention is depicted as being incorporated into multi-purpose, interactive vehicle activity center 20. Vehicle activity center 20 is preferably constructed for use by a child to perform a wide variety of activities relating to various different model vehicles. One principal feature of vehicle activity center 20 is the incorporation therein of audible message information delivery system 21 of the present invention.

In this embodiment, audible message/information delivery system 21 incorporates vehicle interfacing zone 22 which is positioned for cooperative interengagement with any desired model in the group of toy vehicles for which activity center 20 has been created. As shown throughout the drawings, vehicle 23 depicts one particular model of a toy vehicle as a representative example of the plurality of models contained within the particular group of toy vehicles.

As is more fully detailed below, vehicle 23 incorporates a unique vehicle model designating code preferably formed on a bottom surface thereof. In this embodiment, the code is positioned for being read when vehicle 23 is placed in interfacing zone 22.

Once vehicle 23 is properly positioned in zone 22, the model designating code is read and transmitted to the audible message/information delivery system 21 contained within activity center 20. Once properly activated, message/information delivery system 21 audibly delivers, through speaker 34, the precise, selected message that has been prerecorded and specifically created for vehicle 23. Preferably, this message includes such information as the top speed of the actual vehicle represented by model 23, and other pertinent facts, such as the acceleration speed, horsepower, body dimensions, and other facts which are deemed pertinent, such as the number of time the car has been raced, the names of the races it has won, and its famous race drivers.

In accordance with this invention, audible message/information delivery system 21 is capable of storing and delivering a plurality of different, specially designated, audible messages, each of which specifically relates to one particular model vehicle. By positioning vehicle 23 in interfacing zone 22, the model designating code contained on vehicle 23 is transmitted to message/information delivery system 21, enabling system 21 to audibly deliver the single, unique, specific message relating to that particular model.

As a result, children who collect numerous different model vehicles are able to quickly and easily position any of their model vehicles in interfacing zone 22 and activate audible message/information delivery system 21 to deliver the pre-recorded pertinent facts relevant only to the particular model which the child has selected. In this way, children are capable of learning pertinent, relevant facts concerning actual automobiles, for which they have collected representative models in a fun environment. In addition, the child completely controls the activity, with the information being audibly delivered relating only to the vehicles about which the child has selected for learning.

In this preferred embodiment, as depicted in FIGS. 1-3, multi-purpose vehicle activity center 20 incorporates an elongated ramp 24 which interconnects with platform 25 on which interfacing zone 22 is formed. This construction is employed to further enhance the fun activity associated with the present invention. In this embodiment, a child is able to emulate the driving of vehicle 23 on a surface leading up to ramp 24 and then physically advance vehicle 23 up ramp 24 onto platform 25 and into the desired position in interfacing zone 22. Once in this position, audible message/information delivery system 21 can be activated for reading the vehicle model designating code and audibly delivering the precise message created specifically for that particular vehicle model.

In this embodiment, interfacing zone 22 incorporates a plurality of switch means 30 which are employed for cooperating interengagement with recesses formed in vehicle 23. The recesses are employed for defining the particular code which designates model vehicle 23 presently positioned thereon.

In order to determine the precise model positioned in interfacing zone 23, each vehicle 23 incorporates a plurality of cavities or recesses formed in the bottom surface thereof, which are constructed for cooperating interengagement with switches 30. By altering the depth of each of these cavities, each switch 30 is either moved into an "on" position or retained in its normally "off" position. By constructing each identical model of vehicle 23 with the same sequence of cavities, each model of vehicle 23 causes the identical switches 30 to be activated, thereby transmitting one particular coded signal to audible message/information delivery system 21 contained within activity center 20.

Figure 4:
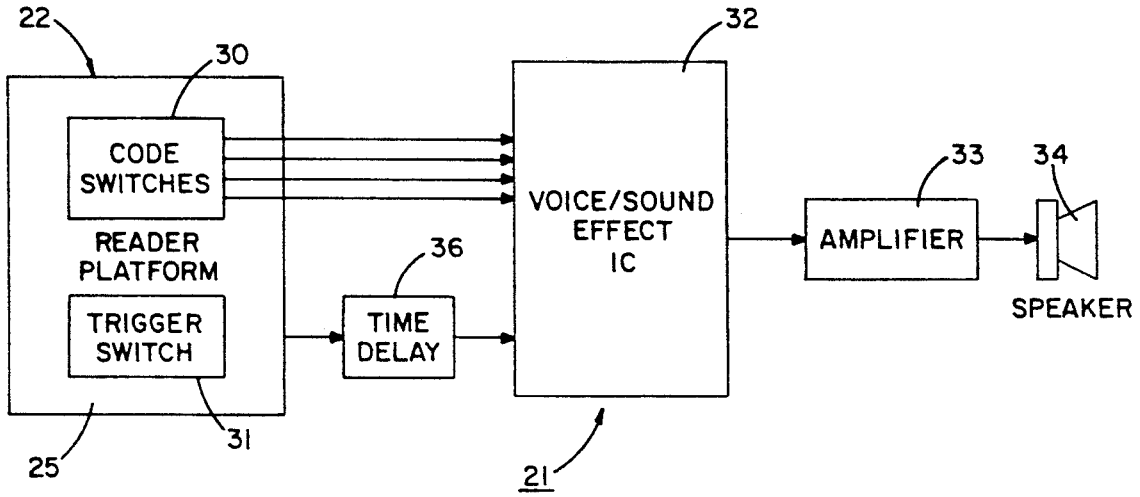
FIG. 4 is a schematic functional block diagram depicting the audible message/information delivery system of the present invention.
Figure 5:
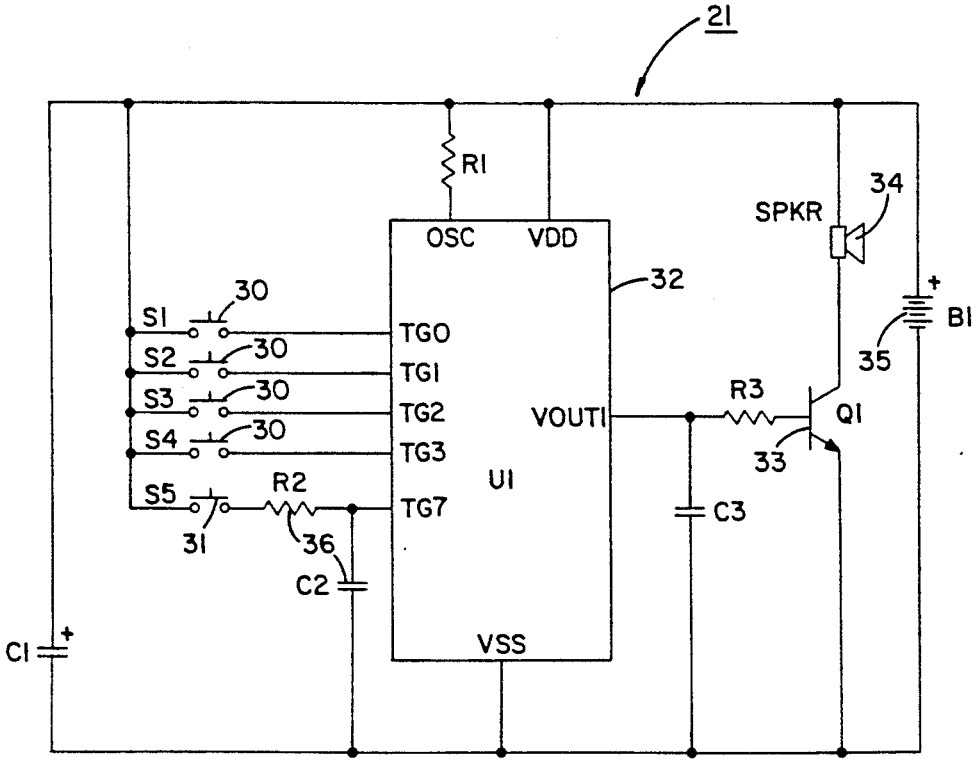
FIG. 5 is a schematic circuit diagram depicting the message/information delivery system of the present invention.

In order to best understand the construction and operation of audible message/information delivery system 21 of the present invention and its construction and operation as an integral part of activity center 20, reference should be had to FIGS. 4 and 5, along with the following detailed disclosure. In FIG. 4, an overall schematic block diagram is provided depicting the preferred construction for audible message/information delivery system 21 of this invention, while FIG. 5 provides a more detailed schematic electronic circuit diagram of system 21 is provided.

As shown in these drawings, interface zone 22 of delivery system 21 incorporates platform 25 on which code reading switches 30 are cooperatingly associated. In addition, in the preferred embodiment, a system activating trigger switch 31 is employed for transmitting a specific deliver message signal. However, as detailed herein, trigger switch 31 is optional and may, if desired, be eliminated.

In the preferred embodiment, code reading switches 30 cooperate with the vehicle code identifiers formed on vehicle 23 to read the precise code contained thereon for identifying that particular vehicle model. Once read, the vehicle identifying code is transmitted from code switches 30 to integrated circuit 32.

Integrated circuit 32 incorporates therein all of the desired message/information transmissions to be delivered to the user. This information comprises detailed information-containing messages delivered by simulated voice transmissions and/or relevant sound effects.

In the preferred embodiment for toy vehicles, integrated circuit 32 comprises a plurality of separate and independent messages, each of which is specially designated for delivering factual information regarding one particular vehicle model. Preferably, this information contains facts concerning the particular vehicle model, such as its speed, acceleration capabilities, fastest speed obtainable, body style, racing statistics, etc., all of which would be relevant and of interest to a child collecting different vehicle models.

Inasmuch as each identical vehicle model incorporates the same code identifier, the placement of that vehicle model on switches 30 causes the same message to be delivered by integrated circuit 32. As a result, only the specific message specially created for that one particular model vehicle is delivered whenever that vehicle model is placed on platform 25, triggering switches 30.

In the preferred embodiment, integrated circuit 32 incorporates a central processing unit (CPU) which is capable of retaining the numerous, independent, specially designated messages, with each message specifically associated with one particular activation code signal. In this way, whenever a vehicle is placed on platform 25, specific, code-identifying switches 30 are activated and the specific code is transmitted to IC/CPU 32. IC/CPU 32 receives the code and determines which of the plurality of messages retained therein is associated with the code being received.

Once a code has been received by IC/CPU 32, IC/CPU 32 delivers the precise message specifically associated with the vehicle placed on platform 25 to amplifier 33 and speaker 34. Preferably, the message is delivered after IC/CPU 32 also receives an activation signal. In this way, the child employing information/message delivery system 21 of the present invention is able to receive, on demand, precise information relating to one particular vehicle selected by the child from a plurality of different vehicles, any time that particular vehicle is placed on platform 25.

As is evident from this disclosure, the present invention attains a unique construction which enables any group or class of toys having a plurality of models or types to be constructed with a particular identifying code associated with each model and a specific message formulated for that single model or type. By incorporating the plurality of different, specific messages in integrated circuit/CPU 32, with each message being audibly delivered only in response to the receipt of the particular code, every different model or type of toy in the group or class of toys is able to be used on the same message/information delivery system, with separate, distinct, independent, messages being provided for each different model or type.

By employing this invention, substantially enhanced educational benefits are derived, and a child playing with the toy is capable of completely controlling the particular information being provided and limiting the information delivered to only those particular models or types of toys in the particular group or class in which the child has an interest. As a result, children can enjoy a sense of control and self-esteem, while also receiving added information and educational benefits.

In the preferred embodiment, as depicted in FIGS. 4 and 5, audible message/information delivery system 21 of the present invention incorporates an activation or triggering switch 31 which is connected to integrated circuit/CPU 32 through time delay circuitry 36. Although various alternate constructions can be employed, the preferred embodiment employs trigger switch 31 and time delay circuitry 36 in order to assure that IC/CPU 32 has received and recognized the entire transmission from code reading switches 30. By employing trigger switch 31 and time delay 36, assurance is provided that vehicle 23 has been positioned in cooperating interconnected relationship with switches 30 and the code contained on vehicle 23 has been properly read and transmitted to IC/CPU 32 before the desired, specific unique message is delivered.

As further detailed herein, trigger switch 31 can be arranged in a plurality of equally effective alternate constructions. In one construction, trigger switch 31 is activated simultaneously with switches 30 as vehicle 23 is placed on platform 25. In this construction, the desired time delay is achieved by delaying the transmission of the output of trigger switch 31 to IC/CPU 32 a sufficient increment of time to be certain that all of the switches 30 have been properly activated and the proper code transmitted to IC/CPU 32. In this embodiment, trigger switch 31 is constructed to mechanically create a time delay, thereby avoiding the need for circuitry 36, by employing a switch with a longer stroke. This produces a built-in mechanical time delay before the switch contacts are engaged.

In a still further embodiment, as detailed herein, a separate and independent switch 31 is employed which must be manually activated by the user after the placement and positioning of vehicle 23 on platform 25. In this way, transmission of the desired coded information to IC/CPU 32 is assured before trigger switch 31 is activated.

In FIG. 5, time delay circuitry 36 is depicted as comprising resistor R2 and capacitor C2. By employing these components, the desired time delay effect is attained. Of course, if desired, mechanical means can be employed, as detailed above. Preferably, both a mechanical time delay and an electronic time delay are employed in combination. In this way, optimum assurance is realized that the precisely desired coded sequence has been fully and completely transmitted to IC/CPU 32 before delivering the desired message.

One of the unique aspects of the present invention is the achievement of IC/CPU 32 which incorporates the plurality of separate and independent audible messages for delivery in response to the receipt by IC/CPU 32 of a specific binary address presented to IC/CPU 32 by employing the simultaneous activation of a plurality of separate switches 30. Depending upon the particular sequence with which the plurality of switches 30 are activated or not activated, a particular binary address is read by IC/CPU 32. Then, based upon address read, the specific message associated with that address is delivered. As detailed above, the delivery of the specific message to amplifier 33 and speaker 34 is preferably delayed until trigger switch 31 and time delay 36, if employed, has been activated and its output signal received by IC/CPU 32.

In FIG. 5, four switches 30 are depicted for exemplary purposes, with a single trigger switch 31 also being employed. By employing four code defining switches 30, sixteen unique binary codes are available. As a result, this would limit the different models and type of toys in the group or class to sixteen separate and distinct models. However, by increasing the number of switches employed, substantially increased numbers of models or types of toys in the group or class can be accommodated.

As depicted in FIG. 5, message/information delivery system 21 is constructed for trouble free activation by employing a power source 35. Typically, replaceable batteries, as shown in FIG. 3, are employed for providing the desired source of power to effectively and efficiently operate information/message delivery system 21 and provide the desired audible, easily understood message to the user.

In the embodiment of this invention depicted in FIGS. 1-3, eight switches 30 are employed for designating the particular code of vehicle 23 placed on platform 25. By employing eight separate and independent switches 30, 256 separate and distinct codes are available for having different messages associated therewith if a separate ground is used. Alternatively, 128 unique codes are available, with one switch being used as ground. Clearly, by altering the numbers of switches being used, any vehicle model 23 in the group of vehicles can be easily accommodated with one specific code designated for that model and a separate and independent message deliverable whenever that model is placed on activity center 20.

As shown in FIG. 3, switches 30 are mounted to printed circuit board 36 which is mounted in activity center 20. In addition, as shown in phantom in FIG. 3, the electronics forming audible message/information delivery system 21 is similarly mounted to printed circuit board 36.

In this embodiment, a separate and independent trigger activating switch 31 is employed in order to initiate the delivery of a particular message through speaker 34. As a result, when this embodiment of the present invention is employed, vehicle 23 is driven by the user into interface zone 22 and placed on platform 25, with the code identifying recesses formed in the bottom of vehicle 23 positioned in contacting interengagement with switches 30.

Once properly positioned, switches 30 read the code formed in the bottom of vehicle 23 and transmits this code to IC/CPU 32 of information/message delivery system 21. Whenever the user is ready to hear the particular message associated with vehicle 23, the user merely presses activation trigger switch 31, thereby causing the immediate activation of system 21 and the delivery of the precisely desired message through speaker 34. In this way, the precisely desired, particular message relating detailed specific information regarding vehicle 23 is delivered to the user upon user demand.

Depending upon the number of models which exist in one particular group or the extensive nature of the information to be provided regarding each unique model or type, IC/CPU 32 can be constructed to be either permanently affixed in the electronic circuitry of audible message/information delivery system 21 or removably interconnectable therewith. In the embodiment depicted in FIGS. 1-3, IC/CPU 32 is constructed to be removably interconnectable to audible message/information delivery system 21. As shown in FIGS. 1 and 2, IC/CPU 32 is constructed in the form of a removable cartridge which is slidingly positionable in cartridge receiving zone 40 for electronic interengagement with connector 41.

By employing IC/CPU 32 in a removable cartridge construction, specific IC/CPU cartridges 32 can be associated with specific model vehicles, thereby allowing the particular message associated with these models to contain extensive information, without affecting the overall memory space available. Furthermore, the use of removable and replaceable IC/CPU 32 cartridges also allows additional models to be added to the group, with new IC/CPU 32 cartridges being made available to continuously expand the number of models or to continuously update the information regarding presently existing models. In this way, longevity and system relevance are substantially enhanced.

Figure 6:
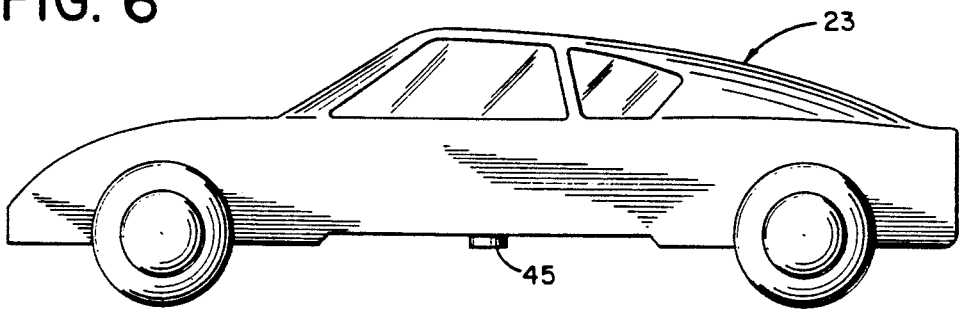
FIG. 6 is a side elevation view of a toy vehicle incorporating an alternate code designating embodiment of the present invention.
Figure 7:
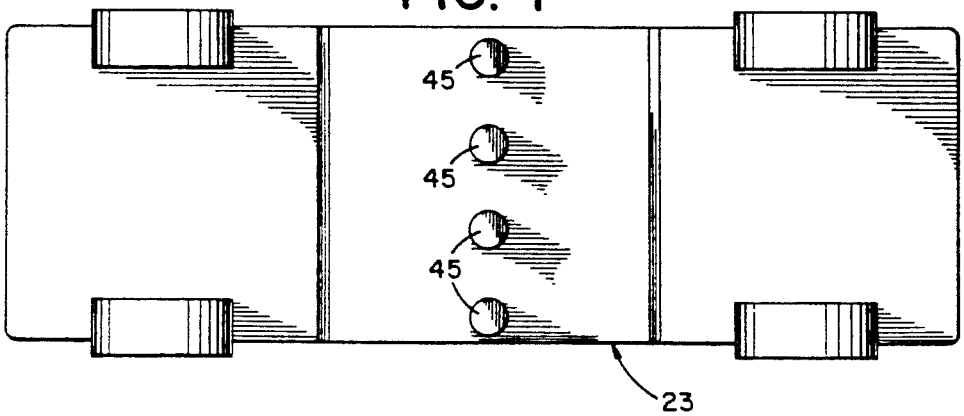
FIG. 7 is a bottom plan view of the toy vehicle of FIG. 6 further depicting the code designation embodiment.

In FIGS. 6 through 9, an alternate embodiment for providing a plurality of unique codes and for reading each of the codes is depicted. As shown in FIGS. 6 and 7, vehicle 23, in this embodiment, incorporates a plurality of pins 45 extending from the bottom surface of vehicle 23. Pins 45 are positioned for mating, contacting, interengagement with switches 30.

Figure 8:
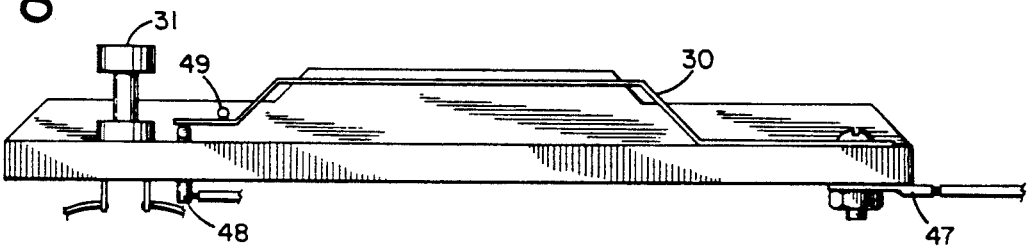
FIG. 8 is a side elevation view of an alternate embodiment of the code reading and activating switch means of the present invention.
Figure 9:
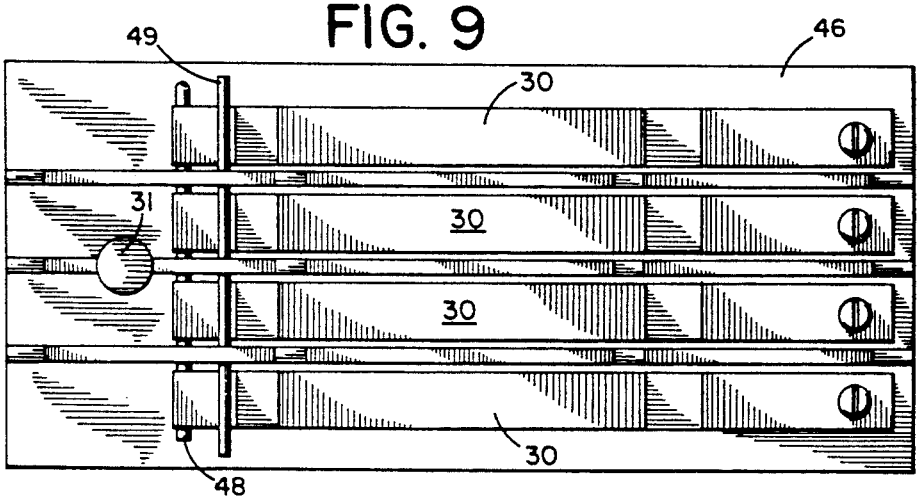
FIG. 9 is a top plan view of the code reading and system activating embodiment of FIG. 8.

In this embodiment, switches 30 comprise elongated, spring biased-leaf springs which are affixed at its proximal end to supporting base 46. As depicted in FIG. 8, this fixed, proximal end of elongated leaf spring switch 30 is connected to contact 47.

As clearly depicted in FIG. 8, switch support base 46 incorporates signal transmitting contacts 47 and 48, each of which are positioned at opposed ends of elongated leaf spring switch 30. When leaf spring switch 30 is physically interconnected with both contacts 47 and 48, an "on" signal is transmitted to IC/CPU 32.

In its normal position, elongated leaf spring 30 is maintained disconnected from contact 48 restrained in this position by elongated stop bar 49. However, whenever a pin 45, extending from the bottom surface of vehicle 23, extends a sufficient distance, switch 30 is forced downwardly, causing the distal end of switch 30 to pivot from its normal position in contact with stop bar 49 into its contacting, circuit closing position, with contact 48. This contacting position is depicted in phantom in FIG. 8.

By controlling the distance pins 48 extend from the bottom surface of vehicle 23, each of the switches 30 is controllably activated either into contacting engagement with contacts 47 and 48 or maintained disconnected from contact 48. In this way, switches 30 are employed to transfer a particular address code to IC/CPU 32 of audible message/information delivery system 21, with which switches 30 and support base 46 are associated. As is evident to one of ordinary skill in the art, alternate constructions can be employed for switches 30 in order to increase the number of switches, if desired, or alter the position of the switches to run perpendicularly to the length of travel of vehicle 23, if so desired. However, regardless of such alterations of construction, the scope of the present invention is not avoided.

In normal use, switch supporting base 46 is incorporated into interfacing zone 22, in order to form the location upon which vehicle 23 is placed in order to transfer the desired code to audible message/information delivery system 21. This embodiment also incorporates a mechanical activation trigger switch 31 which is activated simultaneously with the activation of switches 30.

As is evident from the placement of trigger switch 31, the placement of vehicle 23 on support panel 46 simultaneously causes switches 30 as well as trigger switch 31 to be activated. However, by constructing trigger switch 31 with a longer stroke or travel distance, contacts 30 are activated prior to trigger switch 31 being activated. In this way, the desired delay in the activation of message/information delivery system 21 is attained.

Furthermore, as discussed above, it is preferred that electronic delay circuitry is also employed in order to assure that the precise coded sequence associated with vehicle 23 has been properly interpreted before message/information delivery system 21 is activated. In this way, the precisely desired, specifically designated message is transmitted to the user.

As is evident from the foregoing detailed disclosure, various alterations can be made in the present invention, without departing from the scope of this invention. In particular, in addition to vehicles, any desired toy having a plurality of models or types can be constructed effectively employing the teaching of this invention.

In this regard, toys such as stuffed animals can be constructed with unique identifying codes which can be read by an associated message/information delivery system for presenting specific, specially designated messages relating to that particular model of animal. This message can comprise relevant facts concerning the unique characteristics of that model, as well as describing pet sayings or phrases associated with that model. Similarly, toy dolls, action figures, trucks, airplanes, etc. can all be constructed with unique identifying codes for interfacing with an audible message/information delivery system of this invention to present to the child unique, specially designed messages associated only with one particular model. Consequently, although the present disclosure has detailed this invention in relationship with toy vehicles, it is evident that any group of toys having a plurality of models or types within the group can effectively employ the teaching of the present invention, without departing from the scope of this invention.

It will thus be seen that the objects set forth above, among those made apparent from the preceding description, are efficiently attained and, since certain changes may be made in the above construction, without departing from the scope of the present invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described our invention, what we claim as new and desire to secure by Letters Patent is:

1. A message or information delivery system for providing a pre-recorded, specially designated message selected from a plurality of pre-recorded messages in response to the receipt of a message identifying code, said system comprising A. at least one group of toys having a plurality of separate and distinct models within the group, with each model having a plurality of identical members and selected from the group consisting of toy vehicles, dolls, stuffed animals, airplanes and action figures;

B. separate and distinct code means associated with each member of each model for specifically designating the particular model of the group to which said member belongs; and C. a message delivering/handling member comprising a. at least one input zone for 1. independently receiving and cooperatingly interacting with any member of any model of the group, and 2. determining the identifying code associated with each member, b. electronic circuitry means incorporating a plurality of separate, distinct, individualized prerecorded messages, each of which are specifically associated with at least one particular model, c. processing means for receiving the identifying code and selecting the particular message associated with said code, and d. output means connected to said processing means for receiving the message and audibly delivering the message to the user, whereby a specially created, specific message relating to one particular model in a group of models is uniquely identified and audibly delivered to the user upon demand.

2. The information delivery system defined in claim 1, wherein said system further comprises D. activation switch means constructed for transmitting a message delivery signal to said processing means for enabling said message delivering/handling member to transmit the preselected message to the output means, whereby activation and delivery of the actual message is delayed until receipt of said message delivery signal, thereby assuring that said identifying code has been properly read and transmitted prior to message delivery.

3. The information delivery system defined in claim 2, wherein said electronic circuit means is further defined as being removably interconnected to said message handling member to enable updated messages and system expansions to be effectuated with ease and simplicity.

4. An information delivery system for use with a particular group or class of toys having a plurality of models or types within the group or class, said system constructed for providing a separate, individualized, specific, relevant message for each different model or type within the group, said system comprising A. a group or class of toys a. having a plurality of separate and distinct models or types associated therewith and forming a part of the group or class, with each model having a plurality of identical members, and b. comprising at least one selected from the group consisting of toy vehicles, dolls, stuffed animals, airplanes and action figures;

B. code identifying means a. formed on each member of said models or types of the group or class of toys, and b. comprising a plurality of unique code designations for the group or class, with each model within said group/class having the same code;

C. a code reading and message delivering member comprising a. a single code reading zone 1. constructed for cooperative, code-reading interrelationship with each of the models or types of each group or class of toys, 2. comprising means for separately and individually reading the code means of each member of each model or type of each group or class of toys, and producing and transmitting a code signal corresponding to the identifying code of the model positioned therewith, and b. circuit means comprising 1. storage means incorporating a plurality of individualized, pre-recorded messages, each of said messages being specifically associated with one particular identifying code, and 2. processing means constructed for receiving the code signal and determining the particular pre-recorded message associated therewith; and D. output means constructed for receiving the message to be transmitted and audibly delivering the message.

5. The information delivery system defined in claim 4, wherein said system further comprises E. activation triggering means constructed for delivering a trigger signal when activated and transmitting said trigger signal to the processing means for initiating the output of the selected message.

6. The information delivery system defined in claim 5, wherein said trigger means is further defined as comprising a separate and independent switch constructed for being activated by the user when desired.

7. The information delivery system defined in claim 5, wherein said triggering means is further defined as being automatically activated simultaneously with the reading of the code.

8. The information delivery system defined in claim 5, wherein said activation triggering means is further defined as comprising electronic components formed in the circuitry for generating an electronic delay activation signal whenever the code has been read.

9. The information delivery system defined in claim 4, wherein said storage means and said processing means are further defined as comprising a combined integrated circuit and central processing unit constructed for retaining all of the independent messages for each of the models in the group, associating each of said messages with one specific model identifying code, receiving the code from the code reading zone and determining the precise message associated therewith for transmission.

10. The information delivery system defined in claim 9, wherein said integrated circuit/CPU is further defined as comprising a separate, independent unit constructed for removable connected interengagement with the message delivering member.

11. The information delivery system defined in claim 4, wherein said code identifying means is further defined as comprising recesses formed in the model and the code reading zone comprises a plurality of switches positioned for cooperative contacting interengagement with said recesses for providing either an on or an off output.

12. The information delivery system defined in claim 4, wherein said code is further defined as comprising a plurality of pin means extending from a surface of the model and said code reading zone is further defined as comprising a plurality of movable spring members positioned for cooperative interengagement with said pin means for movement between a first "off" position and a second signal transmitting "on" position, whereby each of said models comprising a unique code designated by a combination of pins formed thereon.

13. The information delivery system defined in claim 12, wherein said spring members are further defined as being normally biased into their "off" position and movable into the "on" position by contacting interengagement with a pin having a sufficient length for controllably moving the spring member.

14. The message information system defined in claim 4, wherein said code reading zone is further defined as comprising a plurality of separate and independent switch means, each being 1. movable between an "off" position and an "on" position, and
2. constructed for transmitting either an "off" or "on" signal to the processing means.

15. The message information system defined in claim 14, wherein said processing means is further defined as receiving the plurality of separate and independent signals from said switch means and integrating said signals into a single message defining code.

16. The information delivery system defined in claim 4, wherein said code reading zone is further defined as comprising an interfacing zone for receiving each model in cooperative association therewith and determining therefrom the particular code associated thereon.

17. An information delivery system constructed for providing a separate, individualized, specific relevant message for each model or type within a group of toys which incorporates a plurality of models or types, said system comprising A. a group of toys consisting of toy vehicles and having a plurality of separate and distinct car and truck models, with each car and truck model having a plurality of identical members, the entirety of which defines the group of vehicles;

B. code identifying means
   a. formed on each car and truck model contained within the group of toy vehicles, and
   b. comprising a plurality of unique code designations for the group of toy vehicles, with each member of each separate and distinct car and truck model within said group having the same code;

C. a code reading and message delivering member comprising
   a. a single code reading zone
      1. constructed for independent, cooperative, code-reading interrelationship with every member of every car and truck model contained within the group of toy vehicles, and
      2. comprising means for separately and individually identifying the code means of each member of the group and transmitting a code signal corresponding to the identifying code of the member positioned therewith, and
   b. circuit means comprising
      1. storage means incorporating a plurality of individualized, pre-recorded messages, each of said messages containing specific, information relevant to one particular car or truck model, and
      2. processing means constructed for receiving the code signal and determining the particular pre-recorded message associated with the car or truck model mounted therewith; and D. output means constructed for receiving the message to be transmitted and audibly delivering the message; whereby a specially created, specific message relating to each car and truck model contained within the group of toy vehicles is identified and audibly delivered to the user upon demand.

18. The information delivery system defined in claim 17, wherein said prerecorded message is further defined as comprising facts and figures relating to one particular car or truck model selected from the group consisting of speed, acceleration capabilities, fastest speed attainable, body style, and racing statistics.

* * * * *